US008900657B2

(12) United States Patent
Matsuhashi

(10) Patent No.: US 8,900,657 B2
(45) Date of Patent: Dec. 2, 2014

(54) TRANSFERRING MEDIUM MANUFACTURING METHOD AND TRANSFERRING MEDIUM

(75) Inventor: Kunihiko Matsuhashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 486 days.

(21) Appl. No.: 12/852,874

(22) Filed: Aug. 9, 2010

(65) Prior Publication Data

US 2011/0033697 A1 Feb. 10, 2011

(30) Foreign Application Priority Data

Aug. 10, 2009 (JP) ..... 2009-185928

(51) Int. Cl.
*B05D 5/10* (2006.01)
*B41M 7/00* (2006.01)
*B41M 3/00* (2006.01)

(52) U.S. Cl.
CPC ..... *B41M 3/006* (2013.01); *B41M 7/009* (2013.01); *B41M 2205/10* (2013.01); *B41M 2205/40* (2013.01)
USPC ..... 427/208.6; 427/207.1

(58) Field of Classification Search
USPC ..... 427/146, 207.1, 208.2, 208.4, 208.6
See application file for complete search history.

(56) References Cited

U.S. PATENT DOCUMENTS

2004/0079254 A1* 4/2004 Hasei ..... 101/485
2007/0046738 A1* 3/2007 Yagi et al. ..... 347/71

FOREIGN PATENT DOCUMENTS

JP 07-314879 12/1995

* cited by examiner

*Primary Examiner* — Michael Cleveland
*Assistant Examiner* — Xiao Zhao
(74) *Attorney, Agent, or Firm* — Workman Nydegger

(57) ABSTRACT

A transferring medium manufacturing method uses a base material, a recording material, and a non-recording material and causes the recording material to adhere to the base material. The transferring medium manufacturing method includes a recording material applying operation in which the recording material is applied to the base material. In a first non-recording material applying operation, the non-recording material is applied to a peripheral part of a recording material applied area. The peripheral part is located along an edge of the recording material applied area. The recording material applied area is an area of the base material where the recording material is applied. In a second non-recording material applying operation, the non-recording material is applied to an inner area, which is surrounded by, and/or located at a relatively inner area position in comparison with an area position of, the peripheral part of the recording material applied area.

3 Claims, 3 Drawing Sheets

TRANSFERRING MEDIUM MANUFACTURING METHOD AND TRANSFERRING MEDIUM

BACKGROUND

1. Technical Field

The present invention generally relates to a transferring medium manufacturing method and a transferring medium. In particular, the invention relates to a transferring medium that can transfer a pattern formed over a base material to a target and a method for manufacturing such a transferring medium.

2. Related Art

A transferring medium that can transfer a pattern such as a character, an image, or the like that is formed over a sheet (base material) to a target is known. The known transferring medium transfers, to the target, the pattern formed by applying ink (recording material) to the sheet. The transferable pattern is coated with adhesive agent (non-recording material). When the pattern formed over the sheet is transferred from the transferring medium to the target, it adheres to the target due to the functioning of the adhesive agent. As the pattern comes off the sheet, it is transferred onto the target.

If the adhesive agent is present not only on the pattern but also at some area other than the area of the pattern over the sheet of the transferring medium, when the pattern formed over the sheet is transferred from the transferring medium to the target, the adhesive agent will be applied not only to an area of the target that corresponds to the area of the pattern but also to some area of the target other than the area of the pattern. Therefore, there is a problem in that the target becomes sticky.

To overcome the above problem, in some transferring media, for example, one disclosed in JP-A-7-314879, adhesive agent is locally applied onto a pattern over a sheet. Specifically, a printing plate is used in the manufacturing of the transferring medium disclosed in JP-A-7-314879. Ink is ejected toward the sheet to form the pattern by using the printing plate. In addition, the printing plate is used to apply the adhesive agent to a limited area, that is, onto the pattern only.

However, the above method of related art in which the printing plate is used to locally apply the adhesive agent onto the pattern, manufacturing cost is comparatively high when the quantity of transferring media manufactured is small. As a method for reducing manufacturing cost when the quantity of transferring media manufactured is small, it is conceivable to locally eject adhesive liquid from nozzles onto a pattern over a sheet.

However, since adhesive liquid has high fluidity, even when the adhesive liquid is ejected onto the area of the pattern only, it could flow on the pattern. For this reason, there is a risk that the adhesive liquid ejected onto the area of the pattern overflows to the outside of the area of the pattern over the sheet.

SUMMARY

An advantage of some aspects of the invention is to provide a transferring medium manufacturing method that makes it possible to manufacture a transferring medium while preventing a non-recording material applied over a base material from flowing outside a predetermined area. In addition, the transferring medium is also provided.

In order to overcome the above-identified disadvantages without any limitation thereto, a transferring medium manufacturing method for manufacturing a transferring medium by using a base material, a recording material, and a non-recording material and by causing the recording material, which is transferable to a target, to adhere to the base material is provided. The transferring medium manufacturing method according to an aspect of the invention includes: recording material applying operation in which the recording material is applied to the base material; a first non-recording material applying operation in which the non-recording material is applied to a peripheral part of a recording material applied area, the peripheral part being located along an edge of the recording material applied area, the recording material applied area being an area of the base material where the recording material is applied; and a second non-recording material applying operation in which the non-recording material is applied to an inner area, which is surrounded by, and/or located at a relatively inner area position in comparison with an area position of, the peripheral part of the recording material applied area where the non-recording material is applied in the first non-recording material applying operation.

In such a manufacturing method, a non-recording material is applied to a peripheral part of a recording material applied area, that is, a part that is located along an edge of the recording material applied area. The non-recording material applied in the first non-recording material applying operation functions as a kind of bank that prevents the non-recording material applied in the second non-recording material applying operation from overflowing to the outside of the area. Therefore, during the manufacturing of a transferring medium, it is possible to prevent a non-recording material applied over a base material from flowing outside a predetermined area.

In a transferring medium manufacturing method according to the above aspect of the invention, it is preferable that the recording material applied to the recording material applied area should form into a recording material layer; and the non-recording material should be applied onto the recording material layer to form into an adhesive layer that is used for adhesion of the recording material layer to the target.

With such a preferred method, since the non-recording material is applied in the first non-recording material applying operation and the second non-recording material applying operation, it is possible to form the adhesive layer that conforms to the shape of the recording material layer on the recording material layer. When the recording material layer is transferred onto a target, the adhesive layer that conforms to the shape of the recording material layer adheres to the target. Since a non-adhesive part of the area of the recording material layer, which means an area where no adhesive force acts, is substantially reduced because of the conformity, it is possible to reduce the risk that the recording material layer comes off. Moreover, since the non-recording material used for forming the adhesive layer does not run off the edge of the recording material layer, it is possible to reduce the risk that an area of the target outside the area of the recording material layer becomes sticky.

Preferably, a transferring medium manufacturing method according to the above aspect of the invention further includes drying operation in which the non-recording material applied in the first non-recording material applying operation is subjected to drying before the second non-recording material applying operation.

With such a preferred method, since the non-recording material applied in the first non-recording material applying operation is subjected to drying in the drying operation, the evaporation of a solvent contained in the non-recording material is accelerated. Thereafter, when the non-recording material is applied in the second non-recording material applying operation, the dried non-recording material applied in the first non-recording material applying operation absorbs a solvent contained in the non-recording material applied in the second non-recording material applying operation. The fluidity of the non-recording material applied in the second non-recording material applying operation decreases because the solvent is absorbed. Therefore, it is possible to further reduce the risk of the overflowing of the non-recording material applied in the second non-recording material applying operation to the outside of the recording material applied area.

A transferring medium manufactured by using a base material, a recording material, and a non-recording material and by causing the recording material, which is transferable to a target, to adhere to the base material is also provided. The transferring medium according to an aspect of the invention includes: a base material layer; a recording material layer that is formed on or over the base material layer by using the recording material; a first non-recording material layer that is formed over the base material layer by using the non-recording material; and a second non-recording material layer that is formed over the base material layer by using the non-recording material, wherein the first non-recording material layer is formed on or over the recording material layer at a peripheral part of the recording material layer, the peripheral part being located along an edge of the recording material layer, the second non-recording material layer is formed on or over the recording material layer at an inner area, which is surrounded by, and/or located at a relatively inner area position in comparison with an area position of, the peripheral part of the recording material layer, and a looped concave is formed at a border where the second non-recording material layer adjoins the first non-recording material layer.

With such a structure, since the first non-recording material layer and the second non-recording material layer are formed in separate steps, it is possible to ensure that the first non-recording material layer and the second non-recording material layer conform to the shape of the recording material layer. Specifically, in a case where the first non-recording material layer is formed first, the looped first non-recording material layer prevents the overflowing of the non-recording material when the second non-recording material layer is formed thereafter. In a case where the second non-recording material layer is formed first, the non-recording material is applied first to the inner part of the recording material layer, which is surrounded by the peripheral part thereof. Since the second non-recording material layer is formed at the inner part, the risk that the non-recording material used for forming the second non-recording material layer runs off the edge of the recording material layer can be reduced. Thereafter, the first non-recording material layer is formed at the peripheral part of the recording material layer. In this way, it is possible to form the first non-recording material layer and the second non-recording material layer that conform to the shape of the recording material layer.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to FIGS. 1 to 5, a transferring medium manufacturing apparatus according to an exemplary embodiment of the invention, which manufactures a transferring medium by ejecting ink onto a sheet of film, will now be explained in detail. The terms "frontward direction" (or rearward direction), "horizontal direction", and "vertical direction" that appear in the following description of this specification mean the "from-back-to-front" direction (or "from-front-to-back" direction when viewed in the reverse orientation), the leftward/rightward (left/right) direction, and the upward/downward (top/bottom) direction shown by arrows in the accompanying drawings, respectively.

Figure 1:
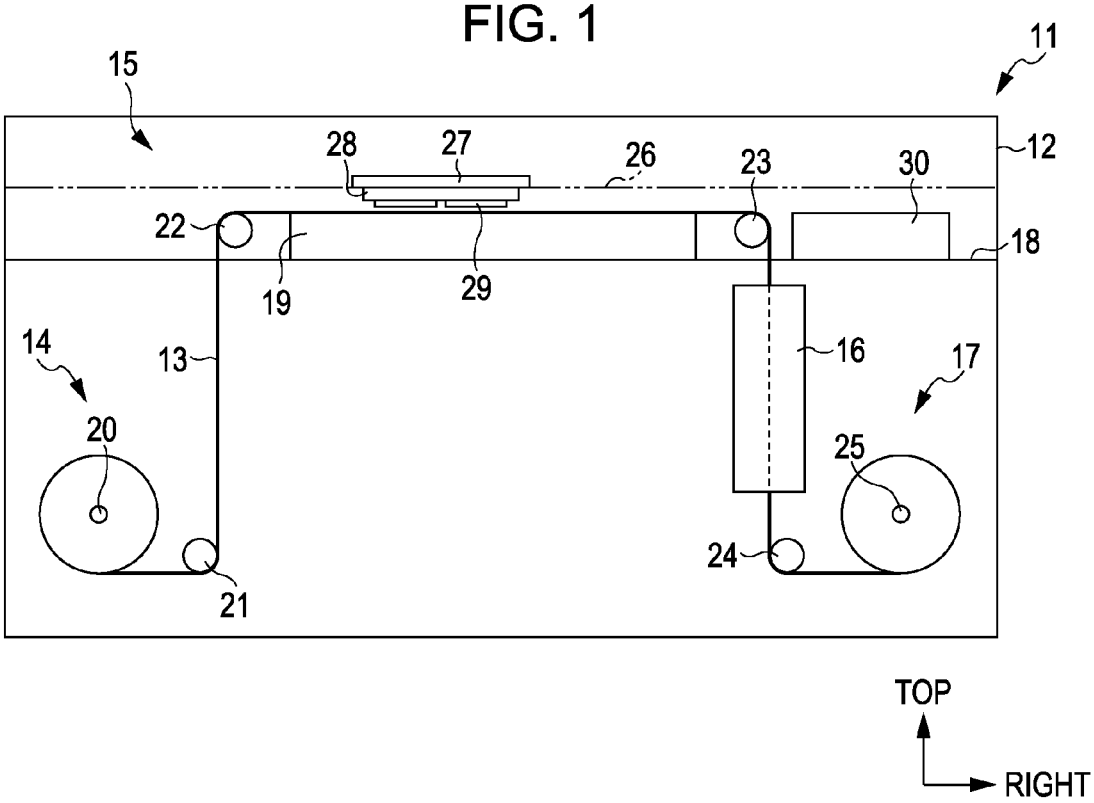
FIG. 1 is a front view that schematically illustrates an example of the configuration of a transferring medium manufacturing apparatus according to an exemplary embodiment of the invention.

A transferring medium manufacturing apparatus 11 has an apparatus body case 12. As illustrated in FIG. 1, the apparatus body case 12 has the shape of a rectangular parallelepiped. A feed reel unit 14, a printing chamber 15, a drying device 16, and a take-up reel unit 17 are provided inside the apparatus body case 12. The feed reel unit 14 functions as a film feeder from which an elongated film 13 is unreeled. In the printing chamber 15, ink is ejected onto the film 13 for printing. The drying device 16 dries the ink on the film 13. The take-up reel unit 17 takes up the film 13 after the drying treatment. The film 13 is an example of a base material according to an aspect of the invention. Ink is an example of a recording material according to an aspect of the invention.

A flat base plate 18 is provided inside the apparatus body case 12 above the center part in the vertical direction. The base plate 18 partitions a space inside the apparatus body case 12 into an upper part and a lower part. The space over the base plate 18 is used as the printing chamber 15. A platen 19 that is formed as a rectangular plate is provided on the base plate 18 in the printing chamber 15. The feed reel unit 14 is provided in the space under the base plate 18 at the left side, which is the upstream side in the direction of feeding movement of the film 13. The drying device 16 and the take-up reel unit 17 are provided in the space under the base plate 18 at the right side, which is the downstream side in the direction of movement of the film 13.

As illustrated in FIG. 1, the feed reel unit 14 includes a roller 20 that extends in the frontward/rearward direction. The film 13 is prepared as a roll on the feeding roller 20. As the feeding roller 20 rotates, the roll of film 13 also rotates. Specifically, the feeding roller 20 rotates when a motor 55 (refer to FIG. 3) applies a driving force thereto. As the feeding roller 20 rotates, the film 13 is unreeled from the feed reel unit 14 toward the downstream side. The unreeled part of the film 13, which is fed off the feeding roller 20, moves to be curved around a first roller 21, a second roller 22, a third roller 23, and a fourth roller 24 in this sequential order. Accordingly, the orientation of the part of the film 13 is changed at each of these rollers 21 to 24 during movement. The motor 55 illustrated in FIG. 3 applies a driving force to a take-up roller 25. As the take-up roller 25 rotates when driven by the motor 55, the film 13 is reeled onto the take-up roller 25.

The second roller 22 and the third roller 23 are provided opposite to each other in the printing chamber 15 with the platen 19 being interposed therebetween. The vertical positions of the second roller 22 and the third roller 23 are pre-adjusted to ensure that the highest point of the circumferential surface of each of the second roller 22 and the third roller 23 is at the same height as the upper surface of the platen 19. Therefore, the reverse face of the film 13 that moves toward the downstream side in the printing chamber 15 is brought into contact with the upper surface of the platen 19 in a sliding manner between the second roller 22 and the third roller 23. A platen heater, which is not illustrated in the drawing, is embedded in the platen 19. An electric current is supplied from a heating device 56 (refer to FIG. 3) to the platen heater so as to generate heat. Therefore, the film 13 supported by the platen 19 is heated thereat.

As illustrated in FIG. 1, a guiding rail 26 that extends in the horizontal direction is provided near each of the front and back of the platen 19 in the printing chamber 15. A two-dot chain line in FIG. 1 shows the pair of guiding rails 26. The upper surface of the pair of guiding rails 26 lies above the upper surface of the platen 19. A movable carriage 27 that has the shape of a rectangle is supported on the upper surface of the pair of guiding rails 26. A carriage driving mechanism that is not illustrated in the drawing supplies power to the carriage 27. When driven by the driving mechanism, the carriage 27 reciprocates in the horizontal direction along the pair of guiding rails 26. A head supporting plate 28 is fixed to the bottom of the carriage 27. A plurality of recording heads 29 is mounted on the supporting plate 28.

The recording head 29 performs recording, for example, printing, by ejecting ink toward the film 13 supported on the platen 19. In addition, the recording head 29 ejects adhesive liquid and protective liquid toward the film 13. The adhesive liquid is an example of a non-recording material according to an aspect of the invention. The recording head 29 functions as a recording material applying means for applying a recording material to (e.g., ejecting ink toward) a base material and functions as a non-recording material applying means for ejecting a non-recording material toward the base material. A maintenance mechanism 30 is provided to the right of the third roller 23 in the printing chamber 15. The maintenance mechanism 30 is used for carrying out maintenance on the recording heads 29 during a period of time in which printing is not performed.

Figure 2:
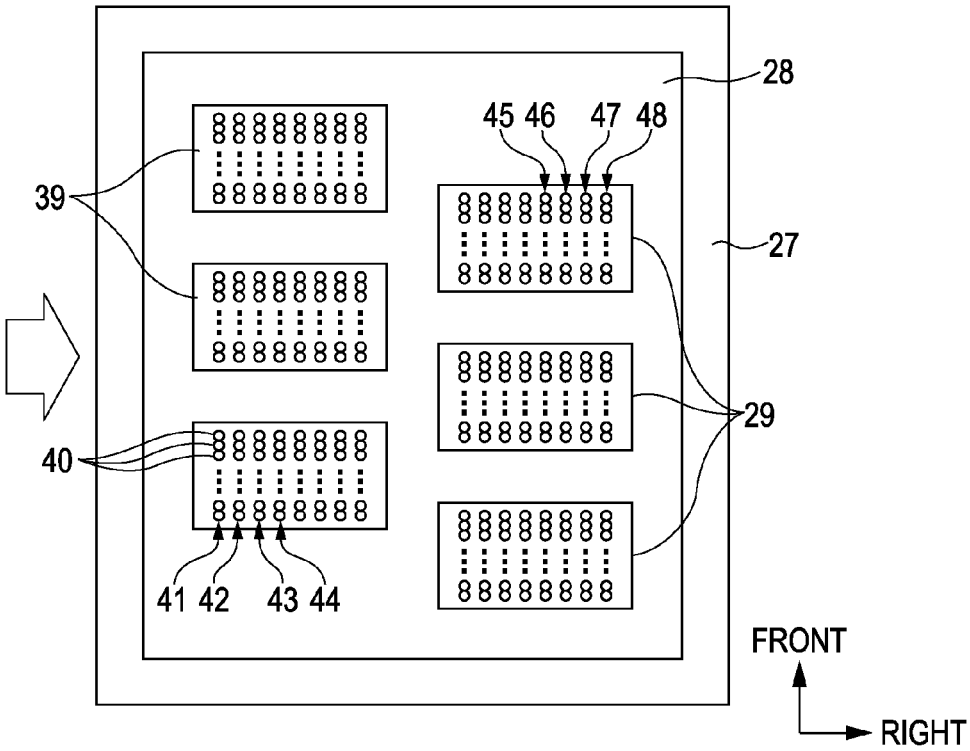
FIG. 2 is a diagram that schematically illustrates an example of the nozzle surfaces of recording heads according to an exemplary embodiment of the invention.

As illustrated in FIG. 2, in the present embodiment of the invention, six recording heads 29 are mounted on the supporting plate 28 fixed to the bottom of the carriage 27. These recording heads 29 are arranged in a staggered layout in the width direction (which is the frontward/rearward direction). The width direction is orthogonal to the direction of movement of the film 13. An empty arrow shows the direction of movement of the film 13 in FIG. 2. Each of the recording heads 29 has a nozzle surface 39 as its bottom surface. A plurality of nozzle lines is formed in the nozzle surface 39. The nozzle lines are formed next to one another at predetermined regular intervals in the horizontal direction. Each of the nozzle lines is made up of a large number of nozzles 40 that are aligned in the frontward/rearward direction. In the present embodiment of the invention, eight nozzle lines, which are first, second, . . . , and eighth nozzle lines 41, 42, . . . , and 48, are formed in each of the recording heads 29. A plurality of types of liquid is supplied from a plurality of cartridges, which is not illustrated in the drawing, to the first to eighth nozzle lines 41 to 48. A set of one cartridge and one type of liquid corresponds to each of the first to eighth nozzle lines 41 to 48. A piezoelectric element 49 is provided for each of the plurality of nozzles 40. When the piezoelectric element 49 vibrates, liquid is ejected from the corresponding nozzle 40. The plurality of piezoelectric elements is collectively shown as a block 49 in FIG. 3.

Specifically, cyan ink, magenta ink, yellow ink, black ink, and white ink are supplied to the first to fifth nozzle lines 41 to 45, respectively. The first nozzle line 41 is the nozzle line that is located at the upstream end in the direction of movement of the film 13 (i.e., the leftmost nozzle line). Metallic ink is supplied to the sixth nozzle line 46, which is the sixth line of the nozzles 40 from the left. A colorant layer 51 (refer to FIG. 5) is formed as a result of the adhesion (applying) of ink ejected from the first to sixth nozzle lines 41 to 46 onto the film 13. The colorant layer 51 is an example of a recording material layer (pattern) according to an aspect of the invention. Herein, the term "metallic ink" means ink produced by dispersing metallic pigment in liquid. When the metallic ink adheres to the film 13, the colorant layer 51 is formed thereon as a metallic foil.

Adhesive liquid is supplied to the seventh nozzle line 47, which is the seventh line of the nozzles 40 from the left. Adhesive liquid according to the present embodiment of the invention is liquid having the following features. Microcapsules each of which contains adhesive agent are dispersed in liquid. It will be subjected to additional treatment such as heating treatment, pressurizing treatment, or the like, which causes the destruction or collapsing of the microcapsules. As a result, the adhesive property thereof increases. Protective liquid is supplied to the eighth nozzle line 48, which is located at the downstream end in the direction of movement of the film 13 (i.e., the rightmost nozzle line).

Figure 3:
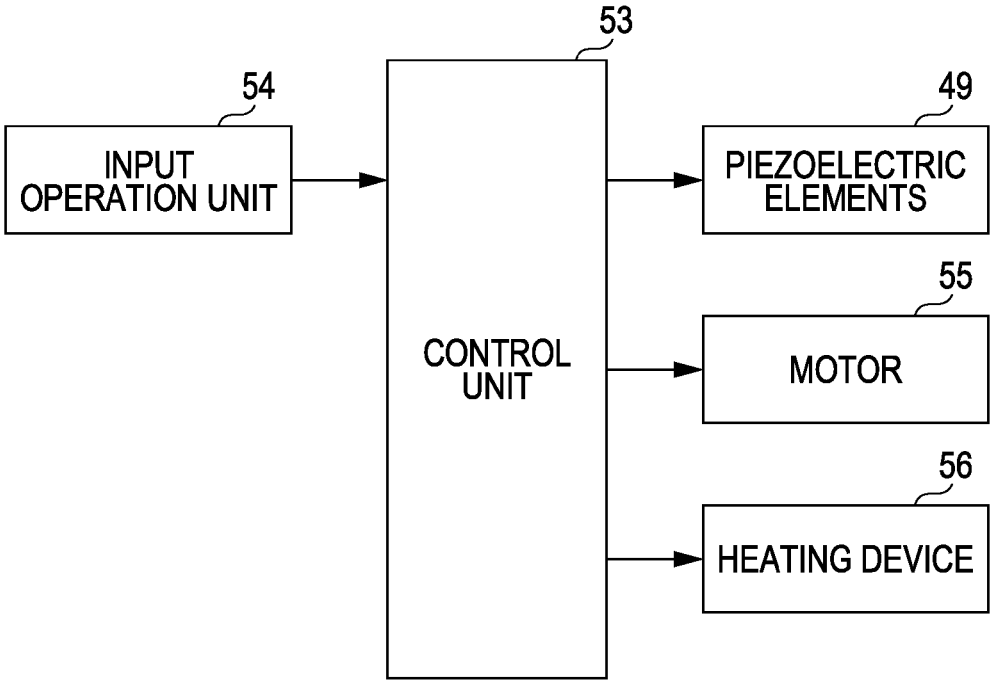
FIG. 3 is a block diagram that schematically illustrates an example of the control configuration of a transferring medium manufacturing apparatus according to an exemplary embodiment of the invention.

As illustrated in FIG. 3, the transferring medium manufacturing apparatus 11 includes a control unit 53. As an integrated controller, the control unit 53 controls the entire operation of the transferring medium manufacturing apparatus 11. For example, the control unit 53 is a microcomputer. A user inputs a command and the like by operating an input operation unit 54. On the basis of the user input, the control unit 53 controls the operation of the piezoelectric elements 49, the motor 55, and the heating device 56.

Figure 4:
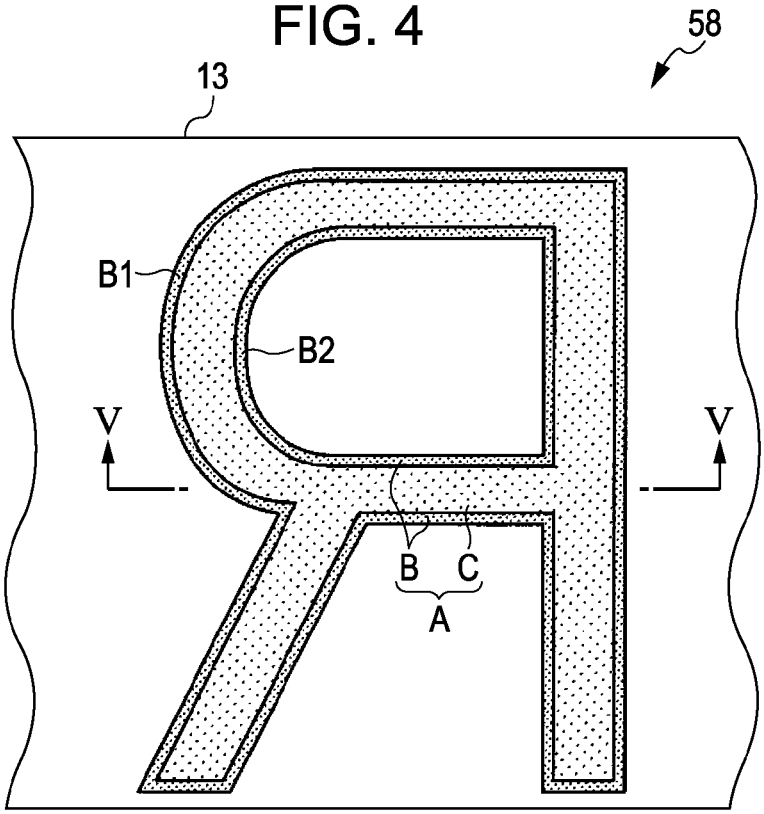
FIG. 4 is a plan view that schematically illustrates an example of a transferring medium according to an exemplary embodiment of the invention.

Next, with reference to FIGS. 4 and 5, a method for manufacturing a transferring medium 58 by using the transferring medium manufacturing apparatus 11 having the above structure is explained. Release agent such as silicon is used to coat each of the upper surface 13*a* and the lower surface 13*b* of the film 13 according to the present embodiment of the invention. As illustrated in FIG. 5A, these layers of coating are formed as an upper releasing layer 59 and a lower releasing layer 60. In the following description, at the time of starting the manufacturing of the transferring medium 58, it is assumed that the film 13 is set ready for feeding along a movement path with its downstream end part being wound around the take-up roller 25.

Figure 5A:
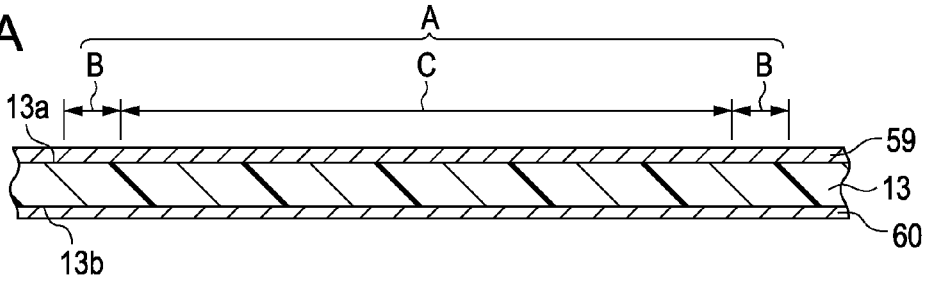
FIGS. 5A to 5E are a set of sectional views that schematically illustrates an example of the process of manufacturing a transferring medium according to an exemplary embodiment of the invention, taken along the line V-V in FIG. 4.

Print data such as character data, image data, or the like that represents a transfer pattern is inputted. For example, an alphabet "R" is inputted as the transfer pattern print data. Upon receiving the input of the print data, the control unit 53 sets a transfer area A where ink is to be applied as illustrated in FIGS. 4 and 5A. The transfer area A is an example of a recording material applied area according to an aspect of the invention. The transferring medium 58 manufactured by the method according to the present embodiment of the invention transfers an image formed therein (defined as "transfer image") onto a target that is not illustrated in the drawing as a mirror reversed image. For this reason, the control unit 53 sets the transfer area A as a mirror reversed image area.

The transfer area A set by the control unit 53 includes a peripheral area B and an inner area C. The peripheral area B is a peripheral part of the transfer area A, which is located along the edge(s) of the transfer area A. The inner area C is an inner part of the transfer area A. The peripheral area B surrounds the inner area C. The peripheral area B is smaller in size than the inner area C. When the transfer area A is set as an area that includes a loop part, the peripheral area B set by the control unit 53 includes an outer peripheral area B1 and an inner peripheral area B2. The outer peripheral area B1 is an outer part of the peripheral area B, which is located along the outer edge of the transfer area A. The inner peripheral area B1 is an inner part of the peripheral area B, which is located along the inner edge of the transfer area A.

When a user operates the input operation unit 54 to start the manufacturing of the transferring medium 58, the control unit 53 drives the heating device 56 to supply an electric current to the platen heater therefrom. The platen heater generates heat. Accordingly, the temperature of the platen 19 increases. The control unit 53 performs control to apply protective liquid, ink, and adhesive liquid to the film 13.

Figure 5B:
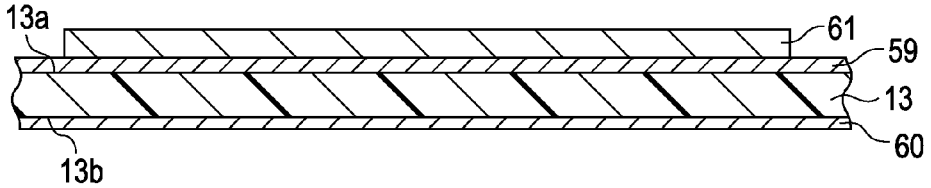

Specifically, as a first step, the control unit 53 causes the piezoelectric elements 49 that correspond to the nozzles 40 that belong to the eighth nozzle line 48 to vibrate in synchronization with the movement of the carriage 27 for ejecting the protective liquid. As illustrated in FIG. 5B, the protective liquid adheres to the transfer area A. The platen 19 heated by the platen heater supports the film 13 to which the protective liquid adheres. Since the heat accelerates the evaporation of a solvent contained in the protective liquid, a protective layer 61 having decreased fluidity is formed over the platen 19.

Figure 5C:
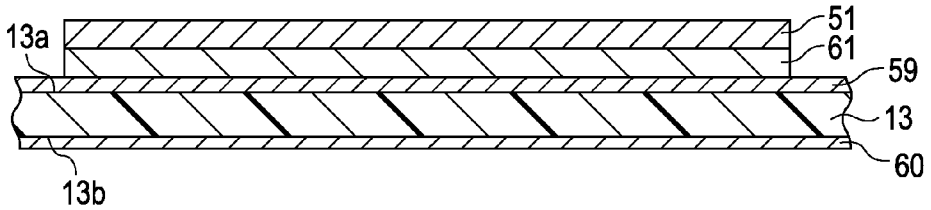

Next, the control unit 53 causes the piezoelectric elements 49 that correspond to the nozzles 40 that belong to the first to sixth nozzle lines 41 to 46 to vibrate in synchronization with the movement of the carriage 27, thereby ejecting ink toward the transfer area A where the protective layer 61 has been formed. As illustrated in FIG. 5C, the colorant layer 51 is formed on the protective layer (a recording material applying step). For example, in a case where the manufactured transferring medium 58 is to be used for metallic-foil transfer, metallic ink is used to form the colorant layer 51. Specifically, metallic ink is applied to the transfer area A first. After the adhesion of the metallic ink at the transfer area A, white ink is applied to the transfer area A to form the silver colorant layer 51 thereat.

Figure 5D:
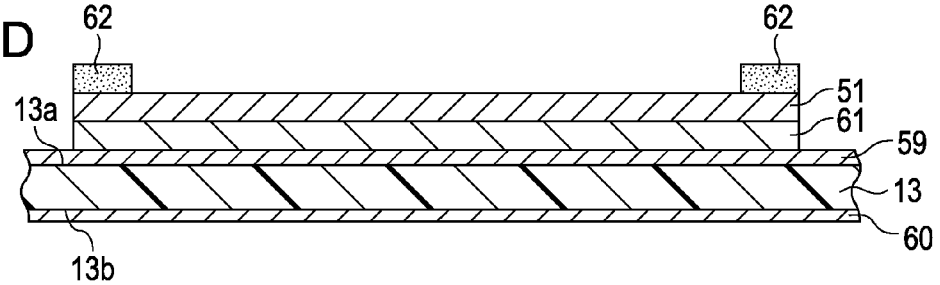

Next, the control unit 53 causes the piezoelectric elements 49 that correspond to the nozzles 40 that belong to the seventh nozzle line 47 to vibrate in synchronization with the movement of the carriage 27 for ejecting the adhesive liquid. As illustrated in FIG. 5D, the adhesive liquid is applied to the peripheral part B of the transfer area A after the formation of the protective layer 61 and the colorant layer 51 (a first non-recording material applying step).

The amount of heat taken away from the platen 19 when the adhesive liquid that adhered to the peripheral area B dries is smaller than the amount of heat taken away from the platen 19 when the adhesive liquid that adhered to the entire transfer area A, which is wider than the peripheral area B, dries. In other words, a decrease in the temperature of the platen 19 that occurs when the adhesive liquid is applied to the peripheral area B is smaller than a decrease in the temperature of the platen 19 that occurs when the adhesive liquid is applied to the entire transfer area A. Therefore, the adhesive liquid applied to the peripheral area B is exposed to the heat of the platen 19 that is kept in a high temperature, resulting in a rapid decrease in fluidity. Thus, in a state in which the adhesive liquid is prevented from flowing outside the peripheral area B, it forms into a first adhesive layer 62 (a drying step). The first adhesive layer 62 is an example of a first non-recording material layer according to an aspect of the invention.

Figure 5E:
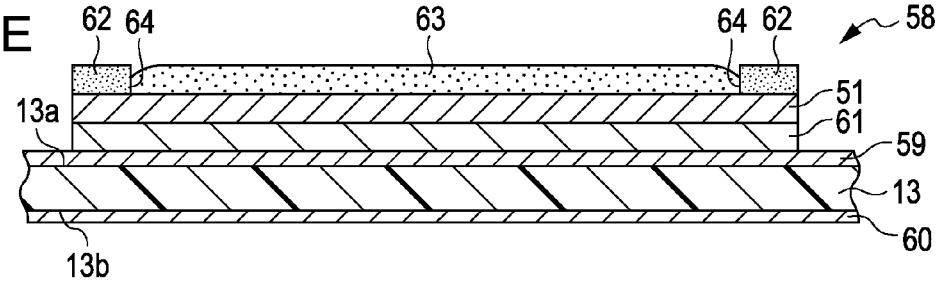

Thereafter, the control unit 53 causes the piezoelectric elements 49 that correspond to the nozzles 40 that belong to the seventh nozzle line 47 to vibrate in synchronization with the movement of the carriage 27 for ejecting the adhesive liquid. As illustrated in FIG. 5E, the adhesive liquid is applied to the inner part C of the transfer area A between the outer peripheral area B1 and the inner peripheral area B2 (a second non-recording material applying step).

Since the inner area C is larger in size than the peripheral area B, the amount of the adhesive liquid applied to the inner area C is larger than that applied to the peripheral area B. Therefore, a decrease in the temperature of the platen 19 is relatively large. For this reason, the adhesive liquid applied to the inner area C maintains fluidity. Droplets of the adhesive liquid that have landed on the inner area C gather to increase the fluidity thereof. Thereafter, as a solvent evaporates, the fluidity of the adhesive liquid decreases gradually.

In the step before the above step of applying the adhesive liquid to the inner area C, the first adhesive layer 62 was formed at the peripheral area B to enclose the inner area C. Therefore, when the adhesive liquid applied to the inner area C comes into contact with the first adhesive layer 62, which has decreased fluidity due to the evaporation of its solvent, the first adhesive layer 62 absorbs a solvent contained in the adhesive liquid applied to the inner area C, which causes a decrease in fluidity. Accordingly, the first adhesive layer 62 functions as a kind of bank that prevents the adhesive liquid applied to the inner area C from overflowing to the outside of the transfer area A. In a state in which the adhesive liquid is prevented from flowing outside the area, it forms into a second adhesive layer 63 in the inner area C. The second adhesive layer 63 is an example of a second non-recording material layer according to an aspect of the invention.

Because of its surface tension, the adhesive liquid applied to the inner area C has a greater thickness at the center region in comparison with its thickness at a border region, which adjoins the first adhesive layer 62. Therefore, the thickness of the edge part of the second adhesive layer 63, which is the part bordering on the first adhesive layer 62, is smaller than that of the center part thereof. That is, a looped concave portion 64 is formed along the first adhesive layer 62 at the bordering part of the second adhesive layer 63.

After the completion of printing on the film 13, the control unit 53 controls the motor 55 to move the film 13 toward the downstream side. The film 13 moved downstream is subjected to drying treatment at the drying device 16. Since the solvent evaporates completely as a result of the drying treatment, the protective layer 61, the colorant layer 51, the first adhesive layer 62, and the second adhesive layer 63 are formed as solid layers over the film 13. Thereafter, the take-up reel unit 17 takes up the film 13 to put it into the form of a roll. In the taken-up state, the first adhesive layer 62 and the second adhesive layer 63 are in contact with the lower releasing layer 60.

The temperature of the drying device 16 is low enough so as not to destroy microcapsules in the first adhesive layer 62 and the second adhesive layer 63. Therefore, a force of adhesion that acts between the lower releasing layer 60 and the first adhesive layer 62 and between the lower releasing layer 60 and the second adhesive layer 63 is weaker than a force of adhesion that acts between the colorant layer 51 and the first adhesive layer 62 and between the colorant layer 51 and the second adhesive layer 63, which were formed into layers in a state in which fluidity was maintained. Accordingly, when the taken-up film 13 is unreeled, the lower releasing layer 60 comes off the first adhesive layer 62 and the second adhesive layer 63. In the unreeled state, the protective layer 61, the colorant layer 51, the first adhesive layer 62, and the second adhesive layer 63 constitute layers over the film 13, specifically, with the protective layer 61 lying on the upper surface 13*a* of the film 13, the colorant layer 51 lying on the upper surface of the protective layer 61, and both the first adhesive layer 62 and the second adhesive layer 63 lying on the upper surface of the colorant layer 51.

In addition, a force of adhesion that acts between the first adhesive layer 62 and the colorant layer 51 and between the second adhesive layer 63 and the colorant layer 51 is stronger than a force of adhesion that acts between the protective layer 61 and the upper releasing layer 59. Utilizing the above difference in the force of adhesion, the colorant layer 51 can be transferred onto a target as follows. As a first step, the first adhesive layer 62 and the second adhesive layer 63 are subjected to additional treatment, which causes the destruction or collapsing of microcapsules therein. The adhesive characteristics of the first adhesive layer 62 and the second adhesive layer 63 appear as a result of the destruction or collapsing of the microcapsules. The first adhesive layer 62 and the second adhesive layer 63 are bonded to the target. Then, the film 13 is peeled off to separate the upper releasing layer 59 from the protective layer 61. In this way, the colorant layer 51 is transferred onto the target. The protective layer 61 covers the surface of the transferred colorant layer 51.

The present embodiment of the invention offers the following advantages.

(1) Adhesive liquid is applied to a peripheral part B of the transfer area A, which is located along the edge(s) of the transfer area A. After the applying of the adhesive liquid to the peripheral area B, the adhesive liquid is applied to the inner area C. The adhesive liquid applied to the peripheral area B functions as a kind of bank that prevents the adhesive liquid applied to the inner area C from overflowing to the outside of the transfer area A. Therefore, during the manufacturing of a transferring medium, it is possible to prevent the adhesive liquid applied over the film 13 from flowing outside a predetermined area.

(2) The adhesive liquid is applied to the peripheral area B in one step and to the inner area C in another step. By this means, it is possible to form the adhesive layers 62 and 63 that conform to the shape of the colorant layer 51 on the colorant layer 51. When the colorant layer 51 is transferred onto a target, the adhesive layers 62 and 63 that conform to the shape of the colorant layer 51 adhere to the target. Since a non-adhesive part of the area of the colorant layer 51, which means an area where no adhesive force acts, is substantially reduced because of the conformity, it is possible to reduce the risk that the colorant layer 51 comes off. Moreover, since the adhesive liquid used for forming the first adhesive layer 62 and the second adhesive layer 63 does not run off the edge of the colorant layer 51, it is possible to reduce the risk that an area of the target outside the area of the colorant layer 51 becomes sticky.

(3) Since the adhesive liquid applied to the peripheral area B is exposed to the heat of the platen 19, the evaporation of a solvent contained in the adhesive liquid is accelerated. When the adhesive liquid is applied to the inner area C, the first adhesive layer 62, which has been formed from the dried adhesive liquid applied to the peripheral area B, absorbs a solvent contained in the adhesive liquid applied to the inner area C. The fluidity of the adhesive liquid applied to the inner area C decreases because the solvent is absorbed. Therefore, it is possible to further reduce the risk of the overflowing of the adhesive liquid applied to the inner area C to the outside of the transfer area A.

(4) The first adhesive layer 62 and the second adhesive layer 63 are formed in two separate steps. With the separate steps, it is possible to ensure that the first adhesive layer 62 and the second adhesive layer 63 conform to the shape of the colorant layer 51. Specifically, in a case where the first adhesive layer 62 is formed first, the looped first adhesive layer 62 prevents the overflowing of the adhesive liquid when the second adhesive layer 63 is formed thereafter. In a case where the second adhesive layer 63 is formed first, the adhesive liquid is applied first to the inner part of the colorant layer 51, which is surrounded by the peripheral part thereof. Since the second adhesive layer 63 is formed at the inner part, the risk that the adhesive liquid used for forming the second adhesive layer 63 runs off the edge of the colorant layer 51 can be reduced. Thereafter, the first adhesive layer 62 is formed at the peripheral part of the colorant layer 51. In this way, it is possible to form the first adhesive layer 62 and the second adhesive layer 63 that conform to the shape of the colorant layer 51.

(5) Since the protective layer 61 is formed between the film 13 and the colorant layer 51, it is possible to form the colorant layer 51 irrespective of chemistry between the film 13 and ink. For example, even when printing is performed on the film 13 that is made of a resin having water-repellent property by using liquid (e.g., ink) that is colored by means of a coloring material such as dye or pigment, the protective layer 61 improves the adhesive property of the ink. Transparent coating agent that contains inorganic minute particles (e.g., silica) and a resin having swelling property can be used for forming the protective layer 61.

The foregoing exemplary embodiment of the invention may be modified as follows.

Adhesive liquid may be applied first to the inner area C to form the second adhesive layer 63 thereat. Thereafter, the adhesive liquid may be applied to the peripheral area B to form the first adhesive layer 62 thereat.

A drying means such as a radiation type heater that radiates electromagnetic waves, a blower that blows air (warm air), or the like may be provided over the platen 19. In such a modified configuration, the drying means dries the adhesive liquid applied to the peripheral area B.

The platen 19 may not be provided with any platen heater. In such a modified configuration, ink applied to the film 13 supported on the platen 19 is allowed to dry naturally.

Not only adhesive liquid but also ink and protective liquid may be applied to the peripheral area B in one step and to the inner area C in another step.

A liquid ejecting apparatus that is used for forming the colorant layer 51 is not limited to an ink-jet printer, which ejects ink for printing. For example, a laser printer that uses toner for printing may be used for forming the colorant layer 51. The printer may be provided with a dedicated head for ejecting adhesive liquid.

Adhesive liquid having high viscosity may be applied to the peripheral area B to form the first adhesive layer 62 thereat. Adhesive liquid may be applied to the inner area C to form the second adhesive layer 63 thereat.

A thermosetting resin may be used as the material of adhesive liquid. Alternatively, a heat reversible resin, which softens when it is heated and hardens when it is cooled, may be used as the material of adhesive liquid. Ultraviolet ray curing adhesive may be used for adhesive liquid. In such a modified configuration, ultraviolet rays are applied as additional treatment.

The ejection of protective liquid may be omitted. Accordingly, it is not always necessary to form the protective layer 61. Alternatively, a film having a pre-formed protective layer may be used.

The recording head 29 may be further provided with a mechanism for ejecting release agent. The recording head 29 may eject the release agent onto the film 13 to form the upper releasing layer 59. In such a modified configuration, the recording head 29 may eject the release agent toward the transfer area A to form the upper releasing layer 59 in such a manner that the upper releasing layer 59 conforms to the shape of the colorant layer 51.

When a transferring medium that has a plurality of transfer areas A is manufactured, it suffices to form the first adhesive layer 62 and the second adhesive layer 63 in at least one of the plurality of transfer areas A. Generally, when adhesive liquid is applied to a small transfer area A, a decrease in the temperature of the platen 19 is less likely to occur because of the small amount of the adhesive liquid applied thereto. In view of the above fact, adhesive liquid may be applied to a peripheral area for each of large transfer areas, whereas the adhesive liquid may be applied to the entire area for each of small transfer areas.

What is claimed is:

1. A transferring medium manufacturing method for manufacturing a transferring medium by using a base material, a recording material, and a non-recording material and by causing the recording material to adhere to the base material, the recording material being transferable to a target, the transferring medium manufacturing method comprising:

recording material applying operation in which the recording material is applied to the base material;

a first non-recording material applying operation in which the non-recording material is applied to a peripheral part of a recording material applied area, the peripheral part being located along an edge of the recording material applied area, the recording material applied area being an area of the base material where the recording material is applied; and a second non-recording material applying operation in which the non-recording material is applied to an inner area, which is surrounded by, and/or located at a relatively inner area position in comparison with an area position of, the peripheral part of the recording material applied area where the non-recording material is applied in the first non-recording material applying operation, wherein the non-recording material applied in the first non-recording material operation directly contacts the non-recording material applied in the second non-recording material operation to thereby form a bank that prevents the non-recording material applied in the second non-recording material operation to overflow, wherein the recording material applied to the recording material applied area forms into a recording material layer; and the non-recording material is applied onto the recording material layer to form into an adhesive layer that is used for adhesion of the recording material layer to the target.

2. The transferring medium manufacturing method according to claim 1, further comprising drying operation in which the non-recording material applied in the first non-recording material applying operation is subjected to drying before the second non-recording material applying operation.

3. The transferring medium manufacturing method according to claim 1, wherein a looped concave is formed where the non-recording material applied in the first non-recording material operation adjoins the non-recording material applied in the second non-recording material operation such that the thickness of the edge part of the second non-recording material is smaller than that of the center part thereof and a concave portion is formed along the first non-recording material at the bordering part of the second non-recording material.

* * * * *